US006764355B2

(12) United States Patent
Ude et al.

(10) Patent No.: US 6,764,355 B2
(45) Date of Patent: Jul. 20, 2004

(54) TERMINAL STRIP ELECTRICAL CONNECTOR

(75) Inventors: Jürgen Ude, Breuberg (DE); Klaus Steinmetz, Flörsheim (DE)

(73) Assignee: Weidmueller Interface GmbH & Co., Detmold (DE)

( * ) Notice: Subject to any disclaimer, the term of this patent is extended or adjusted under 35 U.S.C. 154(b) by 0 days.

(21) Appl. No.: 10/347,583

(22) Filed: Jan. 22, 2003

(65) Prior Publication Data

US 2003/0139099 A1 Jul. 24, 2003

(30) Foreign Application Priority Data

Jan. 24, 2002 (DE) ..... 202 00 973 U

(51) Int. Cl.[7] ..... H01R 4/36
(52) U.S. Cl. ..... 439/811; 439/727
(58) Field of Search ..... 439/810, 811, 439/812, 801, 727, 728, 435, 437, 440, 441, 709, 715, 717

(56) References Cited

U.S. PATENT DOCUMENTS 4,767,354 A * 8/1988 Saligny ..... 439/727 X
5,664,971 A * 9/1997 Coy ..... 439/811
6,146,212 A * 11/2000 Kipnik ..... 439/811 X

FOREIGN PATENT DOCUMENTS

DE 11 32 618 B 7/1962
DE 30 48 497 C2 10/1982
DE 94 10 614.2 U1 9/1994
DE 44 14 148 A1 10/1995
EP 00 80 612 B1 8/1986

OTHER PUBLICATIONS

Rainer Peteratzinger, Search Report, Oct. 21, 2002.

* cited by examiner

*Primary Examiner*—Son V. Nguyen
(74) *Attorney, Agent, or Firm*—Lawrence E. Laubscher, Sr.

(57) ABSTRACT

An electrical connector assembly includes a conductive bridge strap for electrically connecting together a plurality of selected bus bars respectively arranged in chambers contained in a row in the upper portion of a housing formed of synthetic plastic insulating material. Horizontal fastening screws bias the bus bars into respective engagement with conductors inserted downwardly into the chambers via top openings contained in a lid or cover for the housing, and resilient contacts are carried by the bottom portions of the bus bars for engagement by wires inserted upwardly into the chambers via bottom openings contained in the bottom of the housing. In a preferred embodiment, spaced portions of the conductive bridge strap defined by a vertical slot in the leg of the U-shaped bridge member extend within the respective chambers and are permanently secured to the associated bus bars, respectively.

7 Claims, 3 Drawing Sheets

TERMINAL STRIP ELECTRICAL CONNECTOR

BACKGROUND OF THE INVENTION

1. Field of the Invention

An electrical connector includes conductive bridge strap means that electrically connect a plurality of vertical bus bars that are respectively contained in chambers arranged in a row in the top surface of a housing formed from an electrically insulating synthetic plastic material. Fastening screws bias the bus bars into electrical contact with respective conductors inserted downwardly into the chambers, and wires are introduced upwardly into the chambers via bottom openings contained in the bottom of the housing for respective connection with resilient contacts carried by the lower portions of the bus bars. According to a preferred embodiment of the invention, the conductive bridge strap means includes a conductive bridge strap having spaced vertical portions that are permanently secured to the bus bars, respectively.

2. Brief Description of the Prior Art

It is well known in the prior art to provide bridging connections between electrical terminals or contacts carried by a housing formed from an electrically insulating synthetic plastic material. Examples of such bridging connections are set forth in the patents to Hanning, et al. U.S. Pat. No. 5,651,702, Glathe, et al. U.S. Pat. No. 5,722,862, Hanning, et al. U.S. Pat. No. 5,759,071, and Beege, et al. U.S. Pat. No. 6,280,233, all assigned to the same assignee as the present invention.

While these known devices function properly, it is always desirable to produce a less costly terminal connector arrangement that is less costly to produce, easier to assemble and use, and is more rugged and table in use.

SUMMARY OF THE INVENTION

Accordingly, a primary object of the present invention is to provide an improved simple, inexpensive electrical connector, wherein a conductive bridge strap is provided for electrically connecting together a plurality of bus bars arranged within separate chambers contained in the upper surface of a connector housing, fastening screws being provided for biasing the bus bars into contact with conductors introduced downwardly into the chambers, respectively.

According to another object of the invention, resilient terminals are connected with the bottom portions of the bus bars for connection with wires that are inserted upwardly into the chambers via bottom openings contained in the bottom of the housing, respectively.

According to a more specific object of the invention, the bridging strap includes a pair of spaced vertical portions that extend upwardly into the chambers for permanent connection with the associated bus bars contained therein, respectively. The bridge strap has a generally U-shaped cross-sectional configuration, and bus bars are L-shaped and include horizontal lower portions that extend below the base portion of the bridge strap. Resilient tulip-shaped female terminals extend downwardly from the bus bar horizontal lower portions, thereby providing a unitary component that is easily assembled within the connector assembly. The bridge strap may be permanently secured to the bus bars by welding, soldering, brazing, riveting or by an adhesive layer, as desired. While this permanent fastening does require a preassembly manufacturing step, it results in a more positive, rugged and secure connection between the conductive components of the connector.

A further object of the invention is to provide a slot in one leg portion of the U-shaped bridge strap to define the connecting portions of the bridge strap that are connected with the associated bus bars, respectively, the housing including an insulating divider wall or partition that extends into the space or gap defined between the spaced connecting portions. A cover or lid member, which is also formed from a suitable electrically insulating synthetic plastic material, is removably latched to the upper portion of the housing, the cover member being provided with conductor-receiving openings opposite the chambers, respectively.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 2:
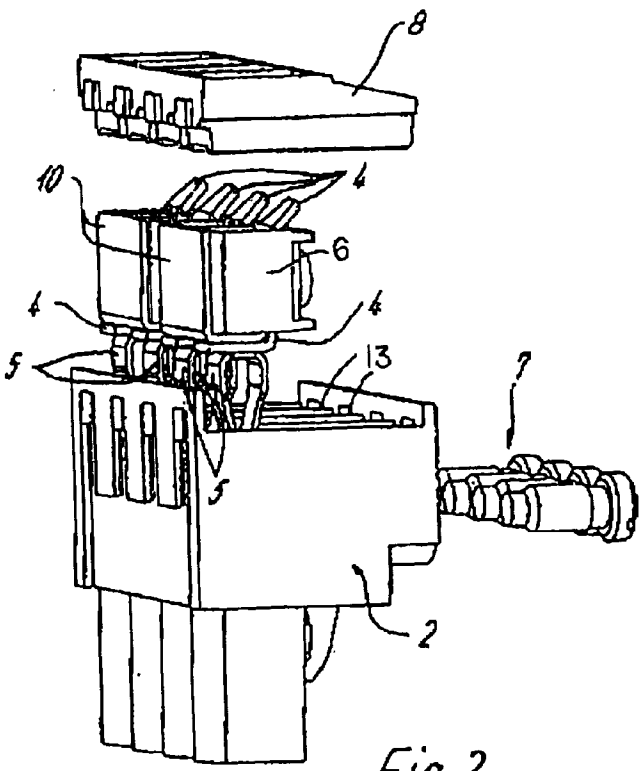
FIGS. 1 and 2 are exploded and partially assembled perspective views, respectively, of the connector assembly of the present invention.
Figure 1:
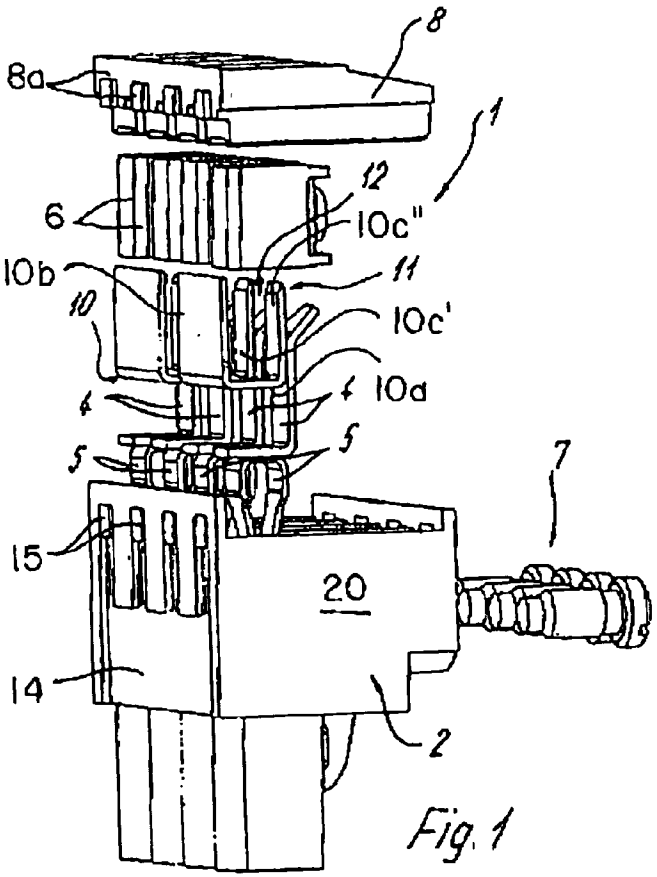
Figure 3:
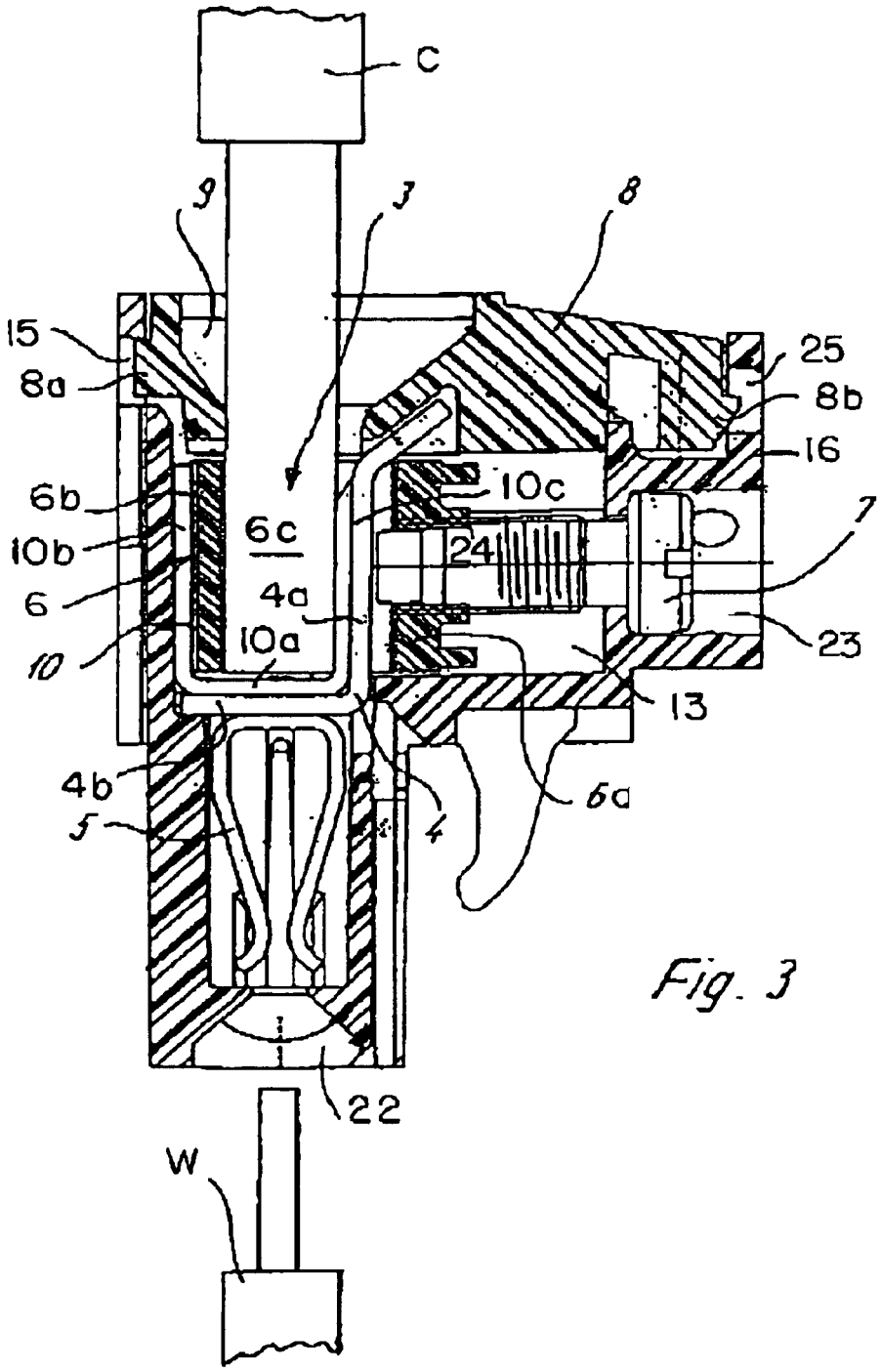
FIG. 3 is a vertical longitudinal sectional view of the assembled connector of FIGS. 1 and 2.

Referring first more particularly to FIG. 1, the connector assembly 1 includes a housing 2 that is formed from a suitable electrically insulating synthetic plastic material. The upper portion of the housing 2 contains a transverse row of chambers 3 in which are mounted a plurality of bus bars 4, respectively. Each of the bus bars has a generally L-shaped configuration and includes a vertical upper portion 4*a*, and a horizontal lower portion 4*b*. As shown in FIG. 3, the vertical portion 4*a* of each bus bar extends within a hollow rigid sleeve member 6 which has a generally rectangular horizontal cross-sectional configuration. The rigid sleeve members 6 are formed from a suitable metal or synthetic plastic material, and contain threaded wall openings 24 (FIG. 3) that threadably receive the fastening screws 7, respectively. A cover or lid member 8 is removably connected with the upper portion of the housing 2 by means of latching projections 8*a* and 8*b* that extend within corresponding latch openings 15 and 25, respectively, contained in the upper portions of the rear and front walls of the housing 2. The cover member 8 contains a plurality of conductor openings 9 that are arranged in a row opposite the chambers 3, respectively, contained in the upper portion of the housing 2.

In accordance with a characterizing feature of the present invention, a plurality of bridge straps are provided for electrically connecting together a plurality of the bus bars 4 arranged in the chambers 3, respectively. As shown in FIG. 3, the bridge connector 10 has a generally U-shaped cross-sectional configuration, and includes a horizontal base portion 10*a*, a first vertical leg portion 10*b* adjacent the housing rear wall 14, and a vertical second leg portion 10*c* adjacent the housing front wall 16. The second leg portion 10*c* contains a vertical slot 12 that divides the bridge leg 10*c* into a pair of conductor portions 10*c*' 10*c*" that are in engagement with the corresponding bus bars 4 contained in the associated housing chambers, respectively. Thus, the two bus bars 4 are connected via the bridge leg portions 10*c*' and 10*c*", the common horizontal base portion 10*a*, and the rear vertical portion 10*b* of the bridge strap 10.

Figure 4:
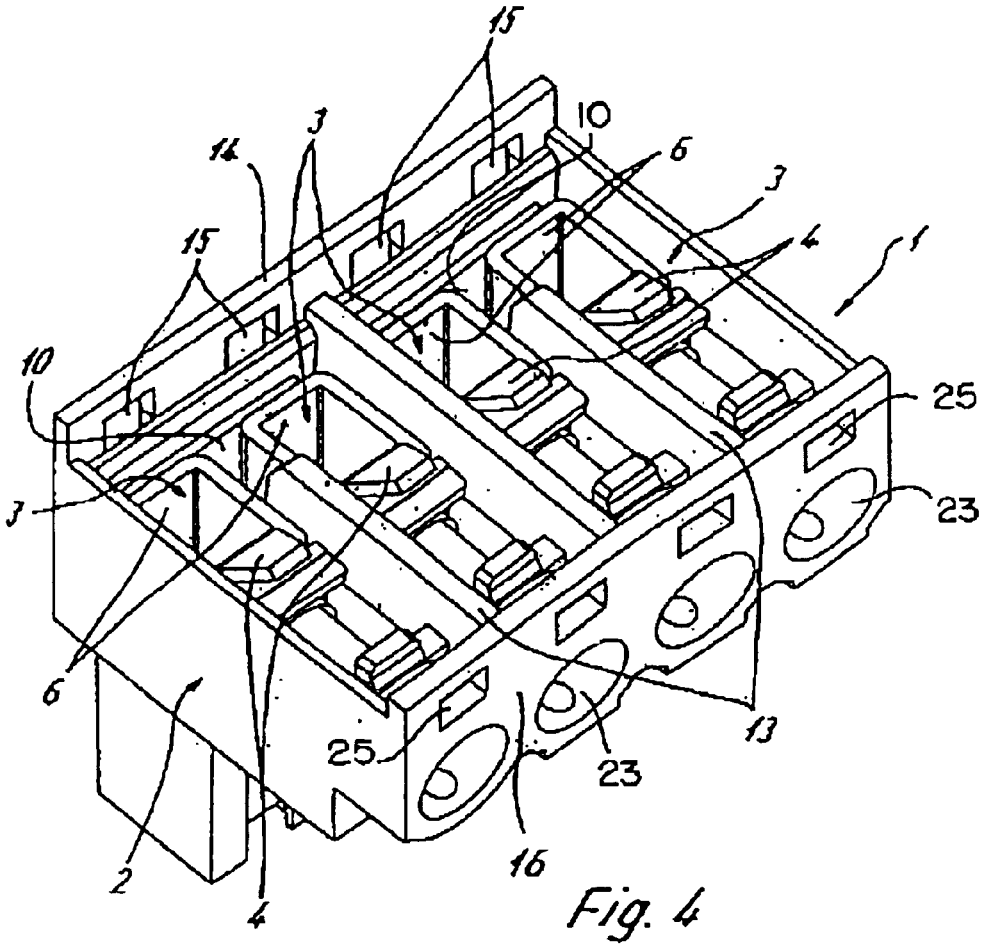
FIG. 4 is a top perspective view of the assembled connector with the lid member removed.

As shown in FIG. 4, the housing 2 further includes a pair of divider walls or partitions 13 that are parallel with the housing side walls 20, respectively. Each of the divider partitions 13 extends between that pair of the sleeve members 6 that contain the bus bars 4 which are electrically connected by the bridge straps 10. The housing divider partitions 13 are formed of electrically insulating synthetic plastic material.

Referring again to FIG. 3, the connector assembly 1 is operable to electrically connect a wire W with a conductor C, as follows. The conductor C is inserted downwardly through the cover opening 9 into the chamber 3 contained in the upper portion of the housing 2, and into the bore 6*c* of the sleeve member 6, the conductor C being an electrical engagement with the bridge strap 10. The fastening screw 7 extends through the bore 23*a* of the counter bore opening 23 contained in the front wall opening 23, the screw having a threaded portion that is threadably connected with the threaded bore 24 contained in the side wall portion 6*a*, of the sleeve member 6. Upon tightening of the screw 7, the bus bar 4 and the associated vertical arm portion 10*c* of the connecting bridge member 10 are biased in the direction of the housing side wall portion 6*b* into tight electrical engagement with the surface of the corresponding conductor C, thereby to rigidly fasten the same to the housing 2. The wire W is inserted upward through the bottom opening 22 of the housing 2, into engagement with the tulip-shaped contacts of the female connector 5, thereby to effect electrical connection between the conductor C and the wires W connected with the bus bars joined by the bridge means 10.

In accordance with the important feature of the invention, the bridge arms 10*c*' and 10*c*" may be permanently secured to the corresponding vertical portions 4*a* of the associated bus bars 4, the permanent fastening being effected by welding, soldering, raising, riveting, gluing, or embossing. In this manner, a rigid, durable, and inexpensive conductor is provided.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. An electrical connector assembly, comprising:

(a) a generally rectangular housing (2) formed of synthetic plastic electrical insulating material and including vertical front (16), rear (14), and side (20) walls, said housing having a horizontal top wall containing a plurality of vertical chambers (3) arranged in a row, and a bottom wall containing a plurality of bottom openings (22) communicating with said chambers, respectively;

(b) a plurality of hollow sleeve members (6) arranged in said chambers, respectively, each of said sleeve members containing a vertical through bore (6*c*), and diametrically opposed side wall portions 6*a*, (c) a plurality of bus bars (4) having vertical portions (4*a*) arranged in said sleeve members adjacent the front wall of said housing, respectively;

(d) a plurality of resilient contacts(S) connected with lower portions of said bus bars opposite said bottom openings, respectively, said resilient contacts being arranged for electrical engagement with wires (W) introduced into said chambers via said bottom openings, respectively;

(e) a plurality of horizontal fastening screws (7) extending through front openings (23) contained is said front wall of said housing (16) opposite and in communication with said chambers, respectively, said fastening screws being threadably connected with corresponding threaded bores (24) contained in side wall portions (6*a*) of said hollow sleeve members, said fastening screws being operable to bias said vertical portions of said bus bars into electrical engagement with conductors (C) introduced vertically into said chambers, respectively; and (f) conductive bridle strap means (10) electrically connecting selected first bus bars of said plurality of bus bars, said bridge strap means including a conductive bridge strap having a generally U-shaped cross-sectional configuration including a horizontal base portion (10*a*) that extends beneath first sleeve members associated with said selected first bus bars, respectively, a fret vertical portion (10*b*) that extends upwardly from said base portion between said rear wall of said housing and said first sleeve members, respectively, and at least one pair of laterally spaced second vertical portions (10*c*) that extend upwardly from the base portion into said first sleeve members in electrical contact with and permanently secured to said selected first bus bars, respectively.

2. An electrical connector assembly as defined in claim 1, wherein said conductive bridge strap is permanently secured to said selected bus bars by welding, soldering, riveting, gluing, or embossing.

3. An electrical connector assembly as defined in claim 1, wherein said housing further includes a vertical divider wall (13) that extends parallel with said housing side walls into the space defined between each said pair of spaced second vertical portions of said bridge strap means.

4. An electrical connector assembly as defined in claim 1, and further including:

(g) a cover member (8) connected with an upper portion of said housing above said chambers, said cover member containing vertical through passages (9) opposite and in communication said chambers, respectively.

5. An electrical connector assembly as defined in claim 4, and further including:

(h) snap fastener means (8*a*, 15; 8*b*, 25) for fastening said cover member to said housing.

6. An electrical connector assembly as defined in claim 1, wherein each of said bus bars has a generally L-shaped configuration and includes a horizontal lower portion (4*b*) that extends below said base portion of said strap means and resilient contacts being connected with said strap by horizontal lower portions, respectively.

7. An electrical connector assembly as defined in claim 6, wherein each of said vertical second portions of said bus bar is arranged on the opposite side of a corresponding vertical portion of said bus bar from a corresponding fastening screw, respectively.

* * * * *